US007267465B2

(12) United States Patent
Mochizuki et al.

(10) Patent No.: US 7,267,465 B2
(45) Date of Patent: Sep. 11, 2007

(54) VEHICULAR HEADLAMP

(75) Inventors: Katsuhito Mochizuki, Shizuoka (JP); Kazuhisa Ashizawa, Shizuoka (JP); Hiroshi Otaka, Shizuoka (JP); Yuji Sugiyama, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/336,066

(22) Filed: Jan. 20, 2006

(65) Prior Publication Data

US 2006/0164852 A1 Jul. 27, 2006

(30) Foreign Application Priority Data

Jan. 24, 2005 (JP) ..... 2005-015746

(51) Int. Cl.
*F21S 8/10* (2006.01)

(52) U.S. Cl. ..... 362/539; 362/507

(58) Field of Classification Search ..... 362/539, 362/512, 284, 324, 467, 507
See application file for complete search history.

(56) References Cited

U.S. PATENT DOCUMENTS 5,373,424 A * 12/1994 Ishikawa ..... 362/538
6,857,768 B2 2/2005 Watanabe et al.

FOREIGN PATENT DOCUMENTS

JP 2003-257218 9/2003

* cited by examiner

*Primary Examiner*—Sharon Payne
(74) *Attorney, Agent, or Firm*—Koda & Androlia

(57) ABSTRACT

A vehicular headlamp including a light blocking moveable shade which is provided to rotate about a rotational axis line that extends in the width direction of a vehicle. The moveable shade is linked to an actuator via a link member and has an outwardly curved upper end edge that extends along the rear focal plane of a projection lens when the moveable shade is in the light shielding or light blocking position. The distance between the rotational axis line and a connection point of the moveable shade and the link member is set to be smaller than the distance between the rotational axis line and the upper end edge of the moveable shade, and the center of gravity of the moveable shade is positioned in the vicinity of the rotational axis line.

2 Claims, 6 Drawing Sheets

VEHICULAR HEADLAMP

BACKGROUND OF THE INVENTION

1. Field of the Invention

The present invention relates to a projector type vehicular headlamp and more particularly to a vehicular headlamp that has therein a moveable shade.

2. Description of the Related Art

Generally, a projector type headlamp includes a projection lens disposed on an optical axis extending in a longitudinal direction of the vehicle, a light source disposed to the rear side of a rear side focal point of the projection lens, and a reflector that reflects light from the light source toward the optical axis. When the projector type headlamp generates a low beam light distribution pattern, a shade provided so that its upper end edge is in the vicinity of the optical axis near the rear side focal point of the projection lens shields a part of the reflected light from the reflector, thus forming a predetermined cut-off line at the upper edge of the low beam light distribution pattern.

Japanese Patent Application Laid-Open (Kokai) No. 2003-257218 discloses a projector type vehicle headlamp, and this headlamp includes a movable shade that can be moved between a light shielding position, where the upper end edge of the moveable shade is positioned in the vicinity of the optical axis near the rear side focal point, and a light transmitting position, at which, as compared to the light shielding position, the amount of reflected light from the reflector that is shielded is reduced.

In the vehicular headlamp of Japanese Patent Application Laid-Open (Kokai) No. 2003-257218, the movable shade is moved to the light transmitting position in order to generate a high beam light distribution pattern. Thus, a single lamp is used for both the low beam and the high beam. Moreover, the upper end edge of the movable shade is curved to extend substantially along the rear side focal plane of the projection lens when the movable shade is in the light shielding position. As a result of this configuration, the cut-off line of the low beam distribution pattern appears distinctly.

The moveable shade of the above-described related art is rotatable about a rotational axis line that extends in the width direction of the vehicle, and this rotational axis line is located at the lower end of the moveable shade and is at a position that is fairly distance from the center of gravity of the moveable shade. As a result, the upper end edge of the moveable shade tends to wobble due to the vibrations of the vehicle, etc., and thus the position of the cut-off line of the low beam distribution pattern tends to change.

In order to suppress this type of wobbling movement, the above-described vehicular lamp has a built-in return spring in the actuator that rotates the moveable shade. The movable shade is normally elastically urged toward the light shielding position by a return spring.

However, in order to effectively suppress the occurrence of this wobbling movement, it is necessary to set the spring constant of the return spring to a somewhat large value. As a result, the driving force required from the actuator for rotating the moveable shade also has to be somewhat large. This in turn makes it difficult to reduce the size and weight of the actuator and to reduce the cost.

Difficulties similar to the above occur not only when switching from the low beam distribution pattern to the high beam distribution pattern but also when switching from the low beam distribution pattern to an intermediate distribution pattern (which is an intermediate distribution pattern that is between the low beam distribution pattern and the high beam distribution pattern).

BRIEF SUMMARY OF THE INVENTION

Accordingly, the object of the present invention to provide a projector type vehicular headlamp that includes a moveable shade and reduces the size, weight and cost of an actuator without having any detrimental impact on the formation of a low beam distribution pattern.

The present invention accomplishes the above object by with various improvements in a moveable shade and the surrounding structure.

More specifically, the above object is accomplished by a unique structure of the present invention for a vehicular headlamp that includes: a projection lens provided on the optical axis of the vehicular lamp, the optical axis extending in the longitudinal direction of a vehicle; a light source provided behind the rear focal point of the projection lens; a reflector provided so as to reflect light from the light source forward and toward the optical axis; a moveable shade provided so as to shield or block a part of the reflected light from the reflector; and an actuator that moves or rotate the moveable shade between the light shielding or blocking position, at which the upper end edge of the moveable shade is near the optical axis, and a light transmitting position, at which the upper end edge of the moveable shade is positioned away from the optical axis; and in the present invention:

the moveable shade is connected to the actuator via a link member and is rotatable about a rotational axis line that is set to be in the widthwise direction of a vehicle, the upper end edge of the moveable shade is curved outwardly so that this curved upper end edge is positioned substantially along the rear focal plane of the projection lens when the moveable shade is in the light shielding or blocking position, and the center of gravity of the moveable shade is positioned in the vicinity of the rotational axis line.

The type of the "light source" is not particularly limited; and, for example, a discharge light source of a discharge bulb and a filament of a halogen bulb can be used for the light source. Moreover, so long as the "light source" is positioned behind or on the rear side of the rear focal point of the projection lens, there is no particular limitation on, for instance, where the light source is provided and where the light source is oriented.

The above-described upper end edge of the "moveable shade" is formed to extend in curvature substantially along the rear focal plane of the projection lens when the moveable shade is in the light shielding position. In addition, the center of gravity of the moveable shade is positioned in the vicinity of the rotational axis line of the moveable shade. So long as these structural features are involved, there are no other specific limitations on the structure of the moveable shade. Here, the "vicinity of the rotational axis line of the moveable shade" means an imaginary cylindrical region that includes the rotational axis line and a region of a certain radius about the rotational axis line of the moveable shade.

The "moveable shade" is provided so as to be rotatable about a rotational axis line that extends in the direction of the width of a vehicle. In this configuration, there is no particular limitation on the structural element that supports the moveable shade. For example, a lens holder, which is provided for supporting the projection lens, or a reflector can be used for supporting or holding the movable shade.

In addition, the "moveable shade" shields or blocks a part of the light reflected from the reflector. In this configuration, so long as a part of the reflected light is shielded or blocked by the moveable shade when the moveable shade is in the light shielding or blocking position, the moveable shade, when it is moved to the light transmitting position, can completely be not blocking the reflected light, or it can partially blocks the reflected light.

The type of the "actuator" is not particularly limited. For example, a solenoid or a stepping motor can be used.

There is no limitation to the structure of the "link member" so long as the link member connects the moveable shade and the actuator so that the driving force of the actuator is transmitted to the moveable shade.

As described above, the vehicular lamp of the present invention is a projector type vehicular headlamp that has a moveable shade. The moveable shade is rotatable about the rotational axis line that extends in the widthwise direction of the vehicle, and the movable shade is linked to the actuator via a link member. Further, the upper end edge of the moveable shade is formed to extend with a curvature substantially along the rear focal plane of the projection lens when the moveable shade is in the light shielding position, and the center of gravity of the moveable shade is positioned in the vicinity of the rotational axis line. The vehicular lamp of the present invention has the advantages as described below.

When the moveable shade is in the light shielding position, the outwardly curved upper end edge of the moveable shade is positioned substantially along the rear focal plane of the projection lens. As a result, cut-off lines of a low beam distribution pattern are formed distinctly.

The center of gravity of the moveable shade is in the vicinity of the rotational axis line, and thus the rotational inertia moment of the moveable shade is reduced to the minimum. As a result, even without increasing the spring constant of the return spring as in the conventional vehicular lamps, it is possible to effectively suppress the wobbling movement of the upper end edge of the moveable shade, which results from vibrations etc. of the vehicle, and to prevent the position of the cut-off lines of the low beam distribution pattern from changing.

As a result of the above-described structure, the driving force required from the actuator for rotating the moveable shade can be minimized, and it is possible to reduce the size, weight and cost of the actuator.

Furthermore, since the connection or link of the moveable shade to the actuator is made by the link member, the size and weight of the moveable shade can be reduced. This structural feature also reduces the driving force that rotates the moveable shade.

As seen from the above, according to the present invention, the vehicular headlamp that includes the moveable shade as described above reduces the size, weight and cost of the actuator without having any detrimental impact on the formation of the low beam distribution pattern. As a result, the overall size, weight and cost reduction of the lamp unit is accomplished.

In the present invention, the distance from the rotational axis line to the connection point of the moveable shade and the link member is set to be smaller than the distance from the rotational axis line to the upper end edge of the moveable shade. With this structure, the present invention provides the advantages as described below.

The (first) distance from the rotational axis line to the upper end edge of the moveable shade is set to be as large as possible in a vertical cross section including the optical axis because the upper end edge of the moveable shade is curved outwardly. Further, the (second) distance from the rotational axis line to the connection point of the moveable shade and the link member is set to be smaller than the (first) distance described above. As a result, the center of gravity of the moveable shade can easily be positioned in the vicinity of the rotational axis line; and in addition it is possible to reduce the size and weight of the moveable shade. Moreover, as a result of the above-described setting and positioning, the drive stroke of an output shaft of the actuator used for rotating the shielding shade can be small, and a further reduction in size, weight and cost of the actuator is accomplished.

In the above structure, with the layout of the lamp etc. in consideration, it is preferable that the actuator be positioned below the optical axis of the lamp and its output shaft is set to be (or extends) substantially parallel to the optical axis. In this structure, the link member can be formed so that it has an L-shaped portion comprising a vertical part, which extends substantially vertically downward from the connection point of the link member and the moveable shade when viewed from the side of the lamp, and a horizontal part, which extends substantially rearward or horizontally from the lower end of the vertical part when viewed from the side of the lamp. With this configuration, the lamp has the advantages as described below.

In the structure described above, the actuator actuates to make a linear reciprocating movement of its output shaft, and this linear reciprocating movement is transmitted by the link member to the moveable shade so that the moveable shade is rotated. In this configuration, though the distance between the ends of the link member would change slightly, since the link member is structured so that the L-shaped portion is formed by the vertical part and the horizontal part, it is possible to easily accommodate any change in the distance between the ends by bending deformation of the L-shaped portion. In addition, as a result of this configuration, there is no need to provide a slide joint or the like at the portion that connects the link member and the moveable shade, and the structure of the lamp is simplified.

In addition, the link member can be formed by a pair of the above-described L-shaped portions, which are disposed on the left and right sides of the optical axis, and a connecting portion, which connects the tip ends of the horizontal parts of the L-shaped portions. With this configuration, the driving force of the actuator is reliably transmitted to the moveable shade, and a deflection deformation can easily occur in the L-shaped portions.

The link member can be formed by a wire spring, which makes it even easier for the L-shaped portions to bend and deform.

DETAILED DESCRIPTION OF THE INVENTION

Figure 1:
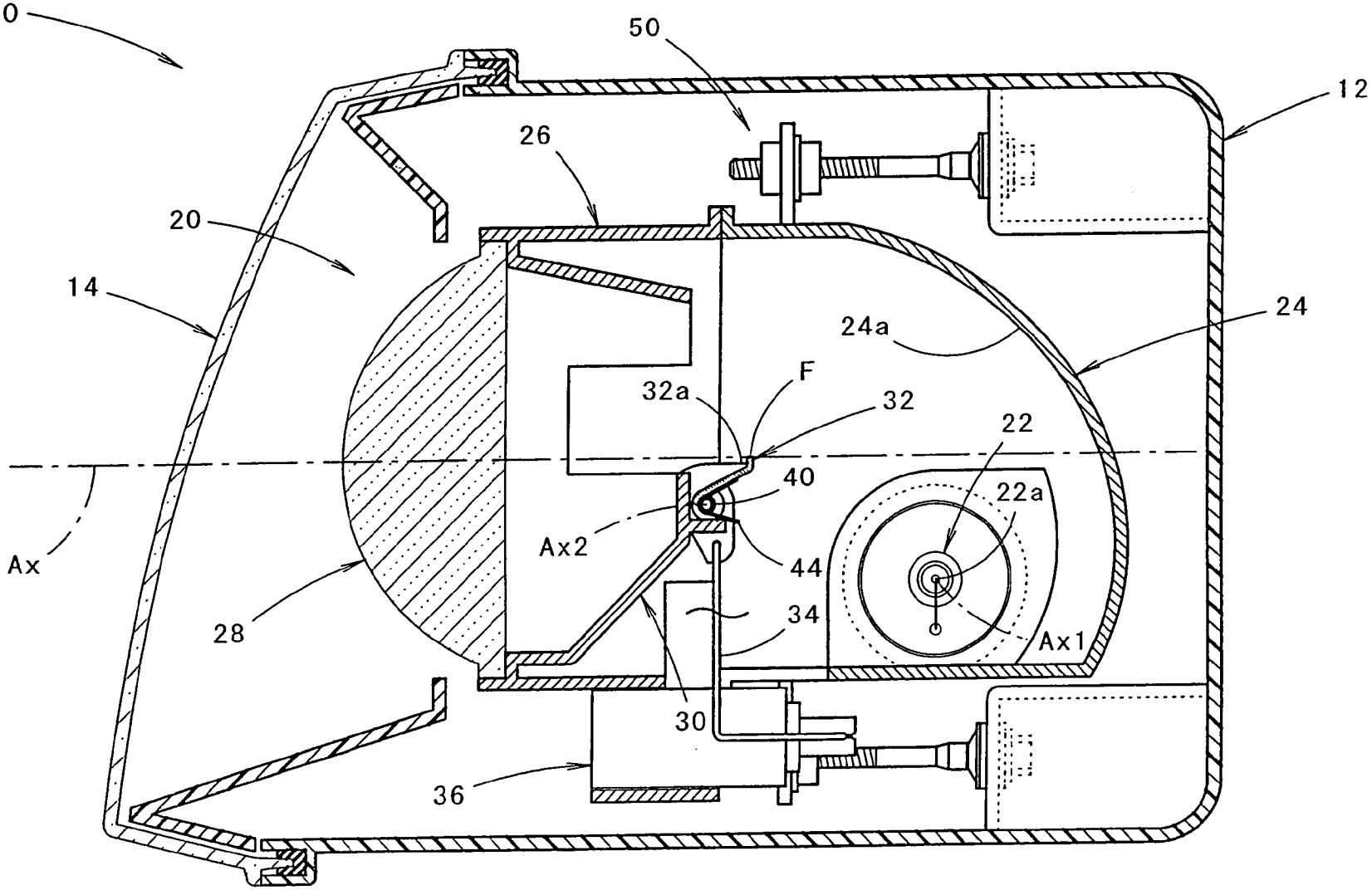
FIG. 1 is a vertical cross sectional side view of the vehicular headlamp according to one embodiment of the present invention.

As seen from FIG. 1, the vehicular headlamp 10 of the present invention is comprised of a lamp body 12, a translucent cover 14, a lamp unit 20, and an aiming mechanism 50. The translucent cover 14 is generally plain and is attached to the front end opening of the lamp body 12. The lamp unit 20 has an optical axis Ax that extends in the longitudinal (front-rear) direction of a vehicle on which the headlamp 10 is mounted. The lamp unit 20 is housed in a lamp chamber formed by the lamp body 12 and the translucent cover 14, and it is tiltable in the vertical direction and the lateral direction by the aiming mechanism 50.

When adjustment of the aiming direction of the lamp unit 20 using the aiming mechanism 50 is completed, the optical axis Ax of the lamp unit 20 is oriented or faces in a direction that is approximately 0.5 to 0.6° downward with respect to the longitudinal direction of the vehicle.

Figure 2:
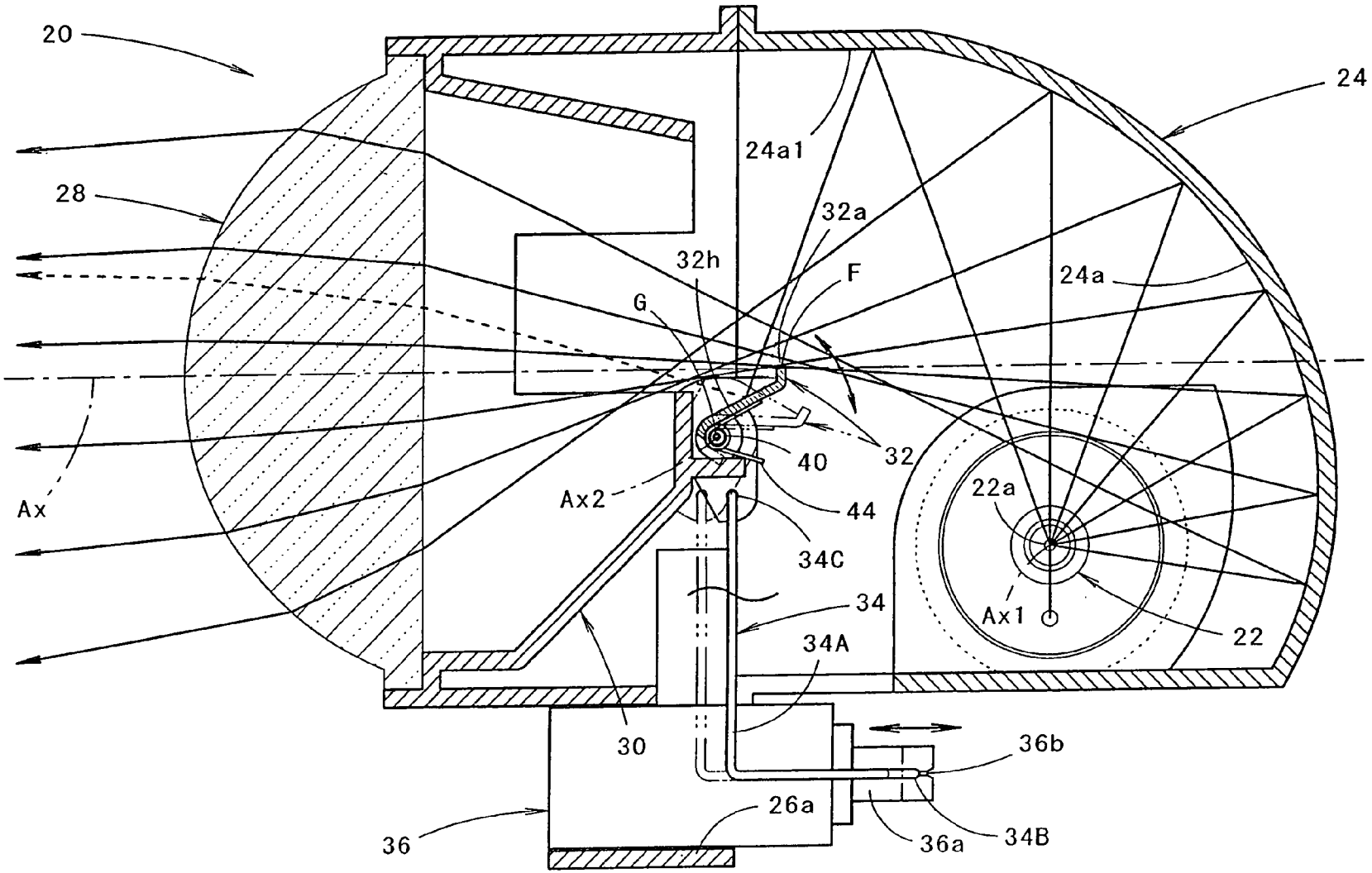
FIG. 2 is a vertical cross sectional side view of the lamp unit installed in the vehicular headlamp of FIG. 1.
Figure 3:
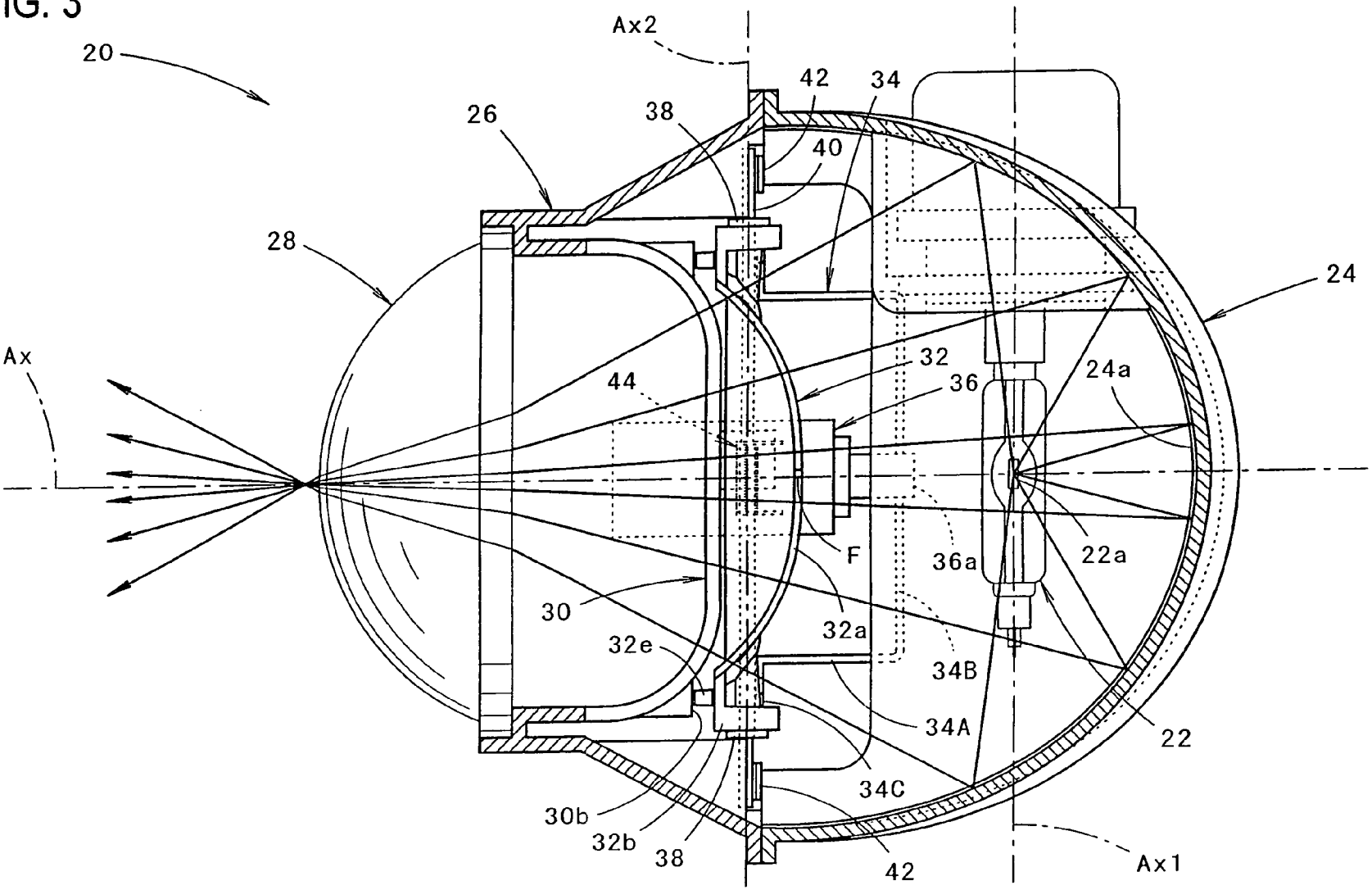
FIG. 3 is a horizontal cross sectional top view of the lamp unit.

The lamp unit 20 is, as seen from FIGS. 2 and 3, a projection type lamp unit, and it includes a light source bulb 22, a reflector 24, a lens holder 26, a projection lens 28, a fixed shade 30, a moveable shade 32, a link member 34, and an actuator 36.

The projection lens 28 is a plano convex lens having a convex front side surface and a flat rear side surface. The projection lens 28 is positioned on the optical axis Ax and is configured so that it projects an image on a focal plane, which includes a rear focal point F, thus forming an inverted image on a vertical virtual screen positioned in front of the lamp 10.

The light source bulb 22 is a discharge bulb such as a metal halide bulb having a light source 22*a* as its discharging light source. The light source 22*a*, as best seen from FIG. 3, is a linear light source that emits light in a direction extending along the bulb central axis Ax1. The light source bulb 22 is inserted and fixed to the reflector 24 from the right side of the optical axis Ax at a position that is in the back of the rear side focal point F of the projection lens 28 and that is apart from and below the optical axis Ax (a position that is, for example, around 20 mm apart from and below the optical axis Ax). The installation (insertion and fixing) of the light source bulb 22 is performed so that the center of light emission of the light source 22*a* is located vertically below the optical axis Ax when the the bulb central axis Ax1 is positioned horizontally in an imaginary vertical plane that is orthogonal to the optical axis Ax.

The reflector 24 has a reflecting surface 24*a* that reflects light from the light source 22*a* forward and toward the optical axis Ax. The reflector 24 is formed so as to have a cross section, which includes the optical axis Ax, in generally an elliptical shape. The eccentricity of the reflecting surface 24*a* gradually increases from the vertical cross section toward the horizontal cross section. As a result of this reflecting surface 24*a*, light from the light source 22*a* and reflected by the reflecting surface 24*a* is caused to generally converge in the vicinity of the rear focal point F in the vertical cross section; and in the horizontal cross section, the convergence point of the light is shifted substantially forward.

The lens holder 26 is formed in a generally cylindrical shape that extends forward from the front end opening of the reflector 24. The rear end of the lens holder 26 is fixed to and supported by the reflector 24, and the projection lens 28 is fixed to and supported by the front end of the lens holder 26.

The fixed shade 30 is shielding stray light reflected by the reflector 24 from entering the projection lens 28, and it is disposed in the space inside the lens holder 26. The fixed shade 30 is formed as a single unit with the lens holder 26.

Figure 4:
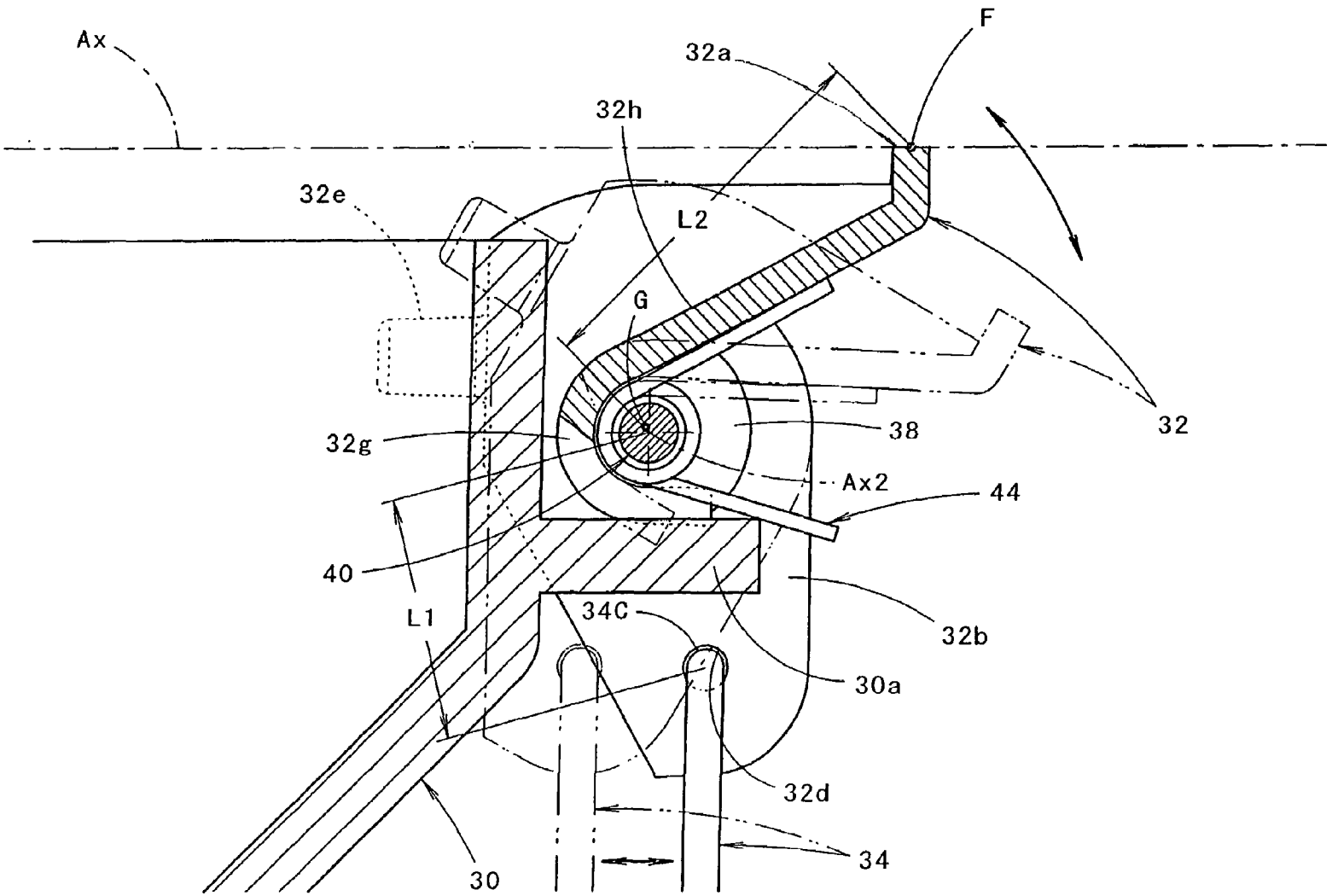
FIG. 4 shows the detailed structure of the main portion of the lamp unit of FIG. 2.
Figure 5:
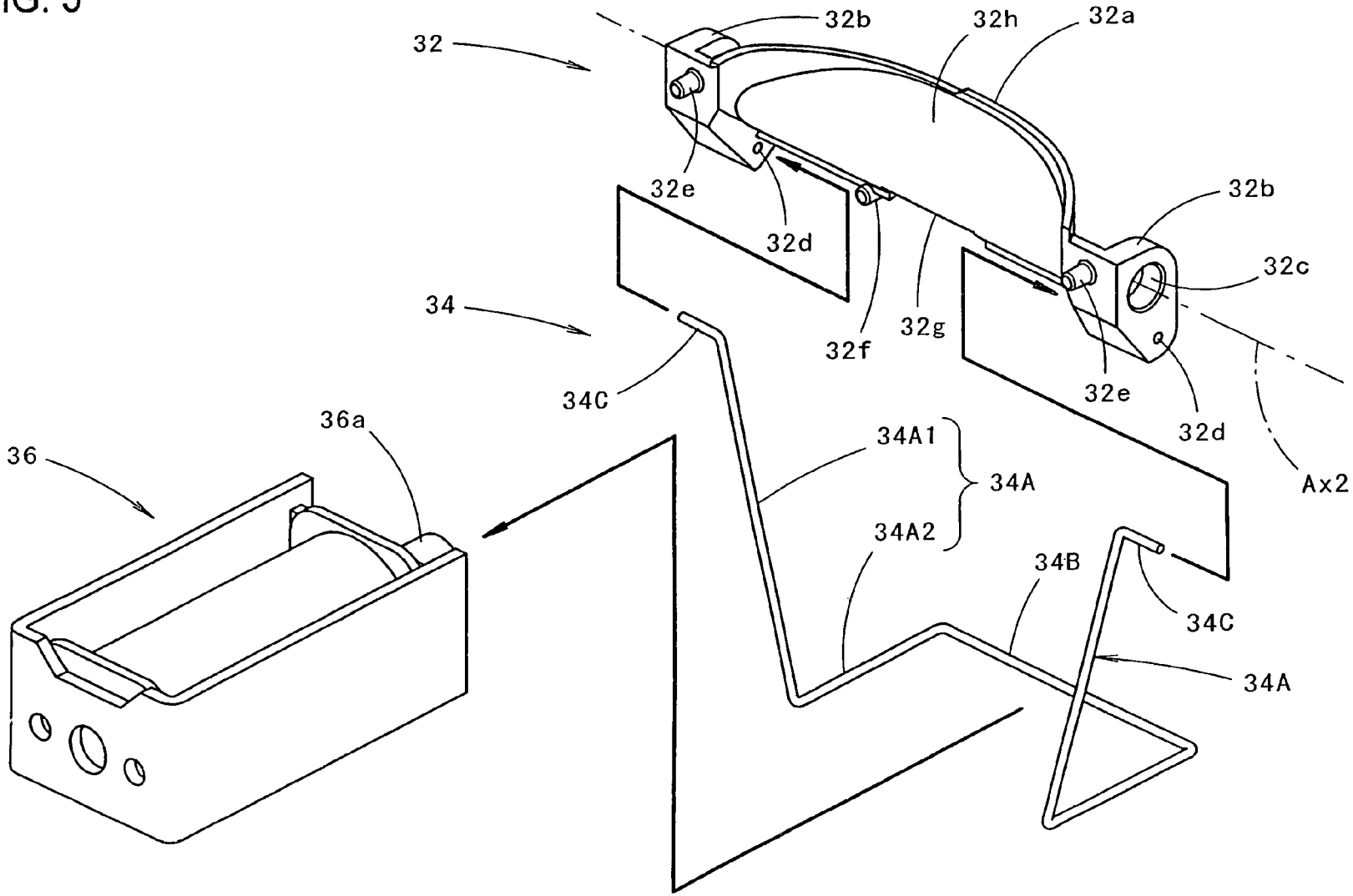
FIG. 5 is an exploded perspective view of the moveable shade of the lamp unit of FIG. 1 shown with the link member and actuator.

FIGS. 4 and 5 show the detail of the moveable shade 32, the link member 34, and the actuator 36.

The moveable shade 32 is die cast element; and, as is apparent from the drawigs, it is provided in the space inside the lens holder 26 and more specifically at a position below and near the optical axis Ax. The moveable shade 32 is provided in the lens holder 26 so that it is rotatable about a rotational axis line Ax2 that extends in the width direction of a vehicle (or in the vertical direction on FIG. 3). The moveable shade 32 is set in a light shielding positon as shown by the solid lines in FIGS. 2 and 4, and it is brought into a light transmitting position which is shown by the two-dot-dash lines when the moveable shade 32 is rotated backward by a predetermined angle as best seen from FIG. 2. As best seen from FIG. 5, the upper end edge 32*a* of the moveable shade 32 is formed with with a step at substantially the middle so that the moveable shade 32 has slightly different height for the right and left sides. When the moveable shade 32 is in the light shielding position, the upper end edge 32*a* extends in a substantially arc-shaped curvature that runs horizontally along the rear focal plane of the projection lens 28.

The the moveable shade 32 is held in the lens holder 26. More specifically, bushes 38 are fitted in the openings 32*c* formed in the lateral end portions 32*b* of the moveable shade 32, and a rotating shaft 40 formed by a metal pin of a predetermined length is inserted in the pair of bushes 38. With the rotating shaft 40 in this state, the rotating shaft 40 is positioned so that it is parallel to the rotational axis line Ax2, and then the both ends of the rotating shaft 40 are fixed to the lens holder 26 by stoppers 42.

In this movealbe shade 32, a slanting surface 32*h* that extends diagonally downward toward the front is formed in an arc-shaped section that is located at the front side of the upper end edge 32*a*. The front end of the standing surface 32*h* is bent around the rotating shaft 40.

The moveable shade 32 is linked, at its both side ends, to the actuator 36 via the link member 34; and when the actuator 36 is actuated, the moveable shade 32 is moved between the light shielding or blocking position and the light transmitting position.

The actuator 36 is configured from a solenoid that is positioned below the optical axis Ax so that the solenoid causes a plunger, which acts an output shaft 36*a* of the actuator 36, to protrude toward the rear. The actuator 36 is provided in the lens holder 26 by being placed on an actuator supporting member 26*a* formed in the lower portion of the lens holder 26.

The actuator 36 is driven or actuated when a beam switching switch, not shown, of the vehicle is operated. Wen the actuator 36 is driven or actuated, the linear reciprocal movement of the output shaft 36*a* is transmitted to the moveable shade 32 via the link member 34, so that the moveable shade 32 is rotated about the rotating shaft 40.

The link member 34, as best seen from FIG. 5, is formed by a wire spring formed by a pair of L-shaped portions 34A positioned at the left and right sides of the optical axis Ax and a connecting portion 34B connectings the L-shaped portions 34A.

More specifically, each L-shaped portion 34A comprises a vertical part 34A1, which extends generally vertically downward from the connection point of the link member 34 and the moveable shade 32, and a horizontal part 34A2, which extends generally backward horozontally from the lower end of the vertical part 34A1. Protrusions 34C are formed in respective upper ends of each vertical part 34A1 and protrude horizontally in opposite directions (or in the width direction of the vehicle). The connectiong portion 34B extends linearly in the width direction of the vehicle as shown by the dashed lines in FIG. 3. Respective ends of the connecting portion 34B are connected to the rear ends of the horizontal parts 34A2 of the L-shaped portions 34A.

The pair of protrusions 34C of the link member 34 are inserted in small holes 32*d* formed in lower ends of the lateral end portions 32*b* of the moveable shade 32, so that the link member 34 is connected to the moveable shade 32. Further, the connecting portion 34B is fitted into a slit 36*b* formed in the output shaft 36*a* of the actuator 36, so that the link member 34 is, as shown in FIG. 2, connected to the actuator 36. The protrusions 34C of the link member 34 are rotatably connected to the moveable shade 32, and the connecting portion 34B of the link member 34 is rotatably connected to the output shaft 36*a* of the actuator 36.

As shown in FIG. 5, a pair of side positioning pins 32*e* are formed in the lateral end portions 32*b* of the moveable shade 32 so as to protrude forward. When the moveable shade 32 is moved to the light shielding position, the pair of side positioning pins 32*e* come in touch with a left-right pair of pin bearing surfaces 30*b* that are formed in the fixed shade 30 so that the side positioning pins 32*e* keep the moveable shade 32 in the light shielding position. Further, a central positioning pin 32*f* is formed to protrude forward from a generally central section of the moveable shade 32. When the moveable shade 32 is moved to the light transmitting position, the central positioning pin 32*f* comes in touch with the fixed shade 30, whereby the movealbe shade 32 is kept in the light transmitting position.

Furthermore, as can be seen from FIGS. 2 to 4, a return spring 44 is fitted on the rotating shaft 40, and as seen from FIG. 4, it is proviced at an axial diretion central portion of the rotating shaft 40. This return spring 44 is a metal torsion coil spring and is provided so that one end thereof is in contact with the moveable shade 32, and the other end is in contact with a tab 30*a* that is formed to protrude backward from the fixed shade 30. The moveable shade 32 is thus continuously urged in an elastic manner toward the light shielding position. A groove 32*g* is formed in the moveable shade 32 to prevent interference of the moveable shade 32 with the tab 30*a*.

As seen from FIG. 4, the center of gravity G of the moveable shade 32 is positioned in the vicinity of the rotational axis line Ax2. More specifically, the position of the center of gravity G of the moveable shade 32 is set so that it is 0.13 mm above the rotational axis line Ax2 and 0.1 mm in front of the rotational axis line Ax2. The poistion of the center of gravity G is adjustable by suitably changing the shape of the moveable shade 32 (for example, the shape of the lower ends of the lateral end portions 32*b* etc.) so that the center of gravity G is sufficiently close to the rotational axis line Ax2.

Furthermore, the moveable shade 32 is designed so that a distance L1, which is from the rotational axis line Ax2 to the center point of the small hole 32*d* (i.e., the connection point of the moveable shade 32 and the link member 34) is set to be smaller than a distance L2, which is from the roational axis line Ax2 to the upper end edge 32*a* of the moveable shade 32 in the vertical cross section including the optical axis Ax.

Next, the optical action of the moveable shade 32 structued as describe above will be described.

As seen from FIG. 2, when the moveable shade 32 is in the light shielding position as shown by the solid lines, the upper end edge 32*a* of the moveable shade 32 is positioned to (laterally) pass through the rear focal point F of the projection lens 28. As a result, part of the reflected light from the reflecting surface 24*a* of the reflector 24 is shielded or blocked by the moveable shade 32, and the majority of the light radiated forward and upward from the projection lens 28 is reduced.

On the other hand, when the moveable shade 32 is moved to the light transmitting position as shown by the two-dot-dash lines in FIG. 2 from the light shielding position, the upper end edge 32*a* is displaced to the rear and in a diagonally downward direction and is thus away from the optical axis Ax, not passing through the rear focal point F of the projection lens 28. As a result, the amount of reflected light which is from the reflecting surface 24*a* of the reflector 24 and shielded or blocked is reduced. In the shown embodiment, when the moveable shade 32 is in the light transmitting postion, the amount of reflected light which is from the reflecting surface 24*a* and is shielded or blocked is substantially zero, and substantially all light from the light source 22*a* is emitted out through the projection lens 28.

The upper front end section 24*a*1 of the reflecting surface 24*a* of the reflector 24 is provided with a different surface configuration from the other sections of the reflecting surface 24*a*. In other words, the upper front end section 24*a*1 of the reflector 24 is formed so that it reflects light from the light source 22*a* toward the slanting surface 32*h* of the moveable shade 32.

When the moveable shade 32 is in the light shielding position, the slanting surface 32*h* of the moveable shade 32 is positioned so that it is diagonally downward to the front as seen from FIG. 2. Accordingly, light from the light source 22*a* reflected by the upper front end section 24*a*1 of the reflector 24 is further reflected diagonally upward toward the front by the slanting surface 32*h* of the moveable shade 32, and it enters the projection lens 28 as shown by the broken lines in FIG. 2 and is then emitted forward from the projection lens 28 in a slightly upward direction. The slanting surface 32*h* of the moveable shade 32 is not mirror-finished. Accordingly, the light reflected by the slanting surface 32*h* and emitted forward from the projection lens 28 has comparatively low intensity.

Figure 6A:
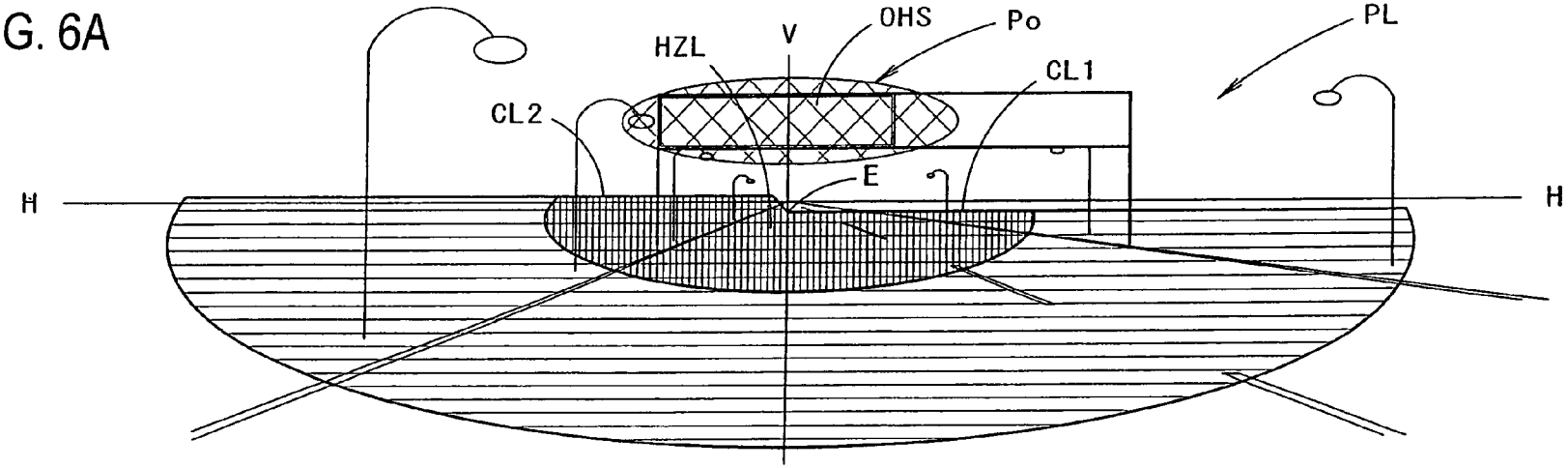
FIG. 6A illustrates the light distribution pattern, particularly a low beam distribution pattern, formed on a virtual vertical screen in front of the lamp by light radiated forward from the vehicular headlamp of the present invention, and FIG. 6B illustrate the high beam distribution pattern formed by the vehicular headlamp of the present invention.
Figure 6B:
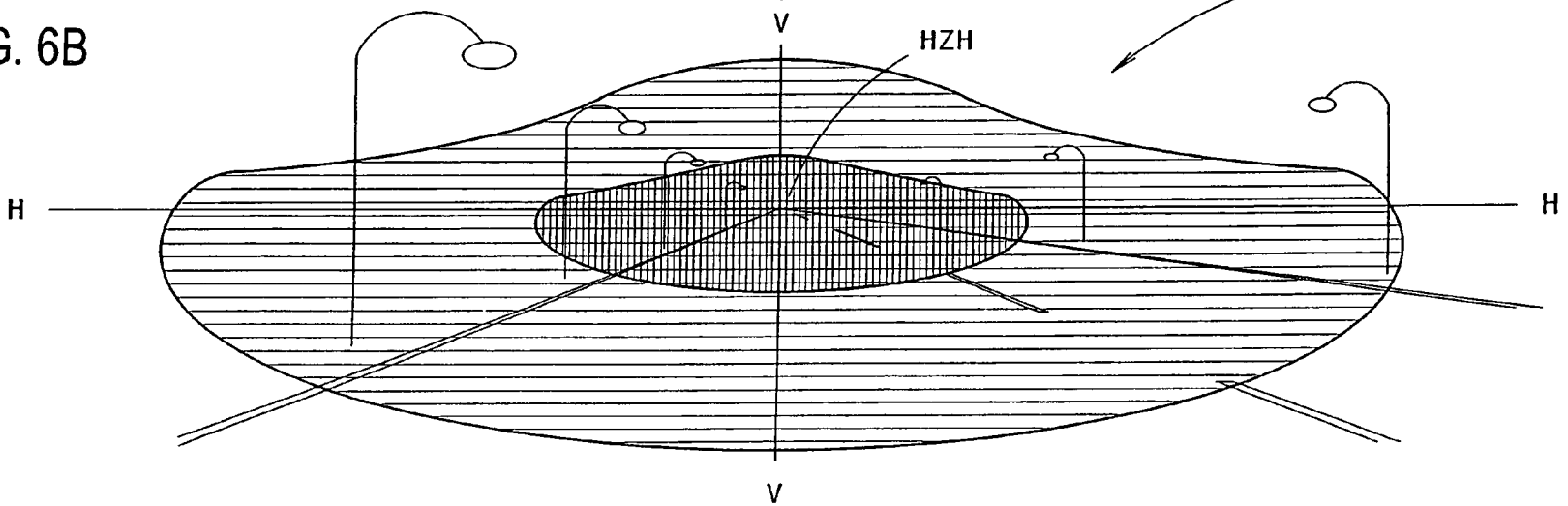

FIGS. 6A and 6B illustrate the light distribution patterns formed on virtual vertical screens positioned 25 meters in front of the vehicular headlamp 10 by the light that is radiated forward from the headlamp 10.

In FIG. 6A, the low beam distribution pattern PL is illustrated, and it is formed when the moveable shade 32 is in the light shielding or blocking position. FIG. 6B illustrates the high beam distribution pattern PH, and it is formed when the moveable shade 32 is in the light transmitting position.

As seen from FIG. 6A, the low beam distribution pattern PL is a left side light distribution pattern. The top end edge of the low beam distribution pattern has cut-off lines CL1 and CL2 that are formed in a stepped fashion in the left-right direction. The cut-off lines CL1 and CL2 extend horizontally and are provided with the left-right direction step at a boundary defined by V-V line that passes vertically through H-V which is a vanishing point to the forward direction of the lamp 10. An oncoming vehicle lane side section which is on the right side of V-V line is formed as the lower step cut-off line CL1, and the driver's vehicle lane side section which is on the left side of V-V line is formed as the upper step cut-off line CL2. The upper step cut-off line CL2 is formed as a raised step that is provided above the lower step cut-off line CL1 with a slanting section in between.

In the low beam distribution pattern PL of FIG. 6A, an elbow point E at the intersection of the lower step cut-off line CL1 and V-V line is positioned below H-V by approximately 0.5 to 0.6°. This is because the optical axis Ax of the lamp unit 20 is, as described above, set downwardly by approximately 0.5 to 0.6° with respect to the longitudinal direction of the vehicle. Further, a hot zone HZL that is an area of high intensity light is formed in the low beam distribution pattern PL to surround the elbow point E.

The low beam distribution pattern PL is formed as an inverted projection image on the virtual vertical screen by the projection lens 28. The low beam distribution pattern PL is a projection of the image of the light source 22*a* formed on the rear focal plane of the projection lens 28 by the light from the light source 22*a* and reflected by the reflecting surface 24*a* of the reflector 24. The cut-off lines CL1 and CL2 are formed as an inverted projection image of the upper end edge 32*a* of the moveable shade 32.

An overhead sign illuminating light distribution pattern Po is formed above H-V as a part of the low beam distribution pattern PL. This overhead sign illuminating light distribution pattern Po illuminates overhead signs (signs above head level) that are in front of the vehicle on the road. The overhead sign illuminating light distribution pattern Po is formed by the light reflected by the slanting surface 32*h* of the moveable shade 32 and emitted forward and diagonally upward from the projection lens 28.

On the other hand, the high beam distribution pattern PH shown in FIG. 6B is formed, in contrast to the low beam distribution pattern PL, to extend somewhat more widely in the upward direction from the cut-off lines CL1 and CL2. The high beam distribution pattern PH has a hot zone HZH in the vicinity of H-V.

As seen from the above description, the vehicular headlamp 10 of the shown embodiment is a projection type vehicular headlamp that includes the moveable shade 32, and the moveable shade 32 is provided so that it is rotatable about the rotational axis line Ax2 that extends in the width direction of the vehicle, and the moveable shade 32 is linked to the actuator 36 via the link member 34. In addition, the upper end edge 32*a* of the moveable shade 32 is formed to have an outwardly expanding curvature so that this outwardly curved upper end edge 32*a* is positioned substantially along the rear focal plane of the projection lens 28 when the moveable shade 32 is in the light shielding or blocking position. Moreover, the center of gravity G of the moveable shade 32 is positioned in the vicinity of the rotational axis line Ax2. Accordingly, the vehicular headlamp 10 has the advantages as described below.

When the moveable shade 32 is in the light shielding or blocking position, the curved upper end edge 32*a* is positioned along the rear focal plane of the projection lens 28. As a result, the cut-off lines CL1 and CL2 of the low beam distribution pattern PL are formed distinctly.

The center of gravity G of the moveable shade 32 is in the vicinity of the rotational axis line Ax2, and thus the rotational inertia moment of the moveable shade 32 is reduced to the minimum. As a result, even without increasing the spring constant of the return spring as in the conventional lamp, it is possible to effectively suppress the wobbling movement of the upper end edge 32*a* of the moveable shade 32, which results from vibrations etc. of the vehicle, and thus it is possible to prevent the position of the cut-off lines CL1 and CL2 of the low beam distribution pattern PL from changing.

Accordingly, the driving force required from the actuator 36 for rotating the moveable shade 32 can be smaller, and the size, weight and cost of the actuator can be thus reduced.

In addition, since the linking of the moveable shade 32 to the actuator 36 is made by the link member 34, the size and weight reduction of the moveable shade 32 is further accomplished. This structural feature also reduces the driving force required by the actuator 36 for rotating the moveable shade 32.

As seen from the above, according to the above-described embodiment of the present invention, in the vehicular headlamp 10 that includes the moveable shade 32, the size, weight and cost reduction of the actuator 36 is accomplished without having any detrimental impact on the formation of a low beam distribution pattern; and as a result, the size, weight and cost reduction of the lamp unit 20 can be reduced.

In the shown embodiment, the distance L1 from the rotational axis line Ax2 for the movable shade 32 to the connection point of the moveable shade 32 and the link member 34 is set to be smaller than the distance L2 which is from the rotational axis line Ax2 to the upper end edge 32*a* of the moveable shade 32. As a result, the lamp has the advantages as described below.

The distance L2 from the rotational axis line Ax2 to the upper end edge 32*a* of the moveable shade 32 is as large as possible in the vertical cross section including the optical axis Ax because the upper end edge 32*a* of the moveable shade 32 is curved outwardly. Further, the distance L1 from the rotational axis line Ax2 to the connection point of the moveable shade 32 and the link member 34 is set to be smaller than the distance L2. As a result, the center of gravity G of the moveable shade 32 can be easily positioned in the vicinity of the rotational axis line Ax2, and it is possible to promote the size and weight reduction in the moveable shade 32. Moreover, as a result of the above-described setting and positioning, the drive stroke of the output shaft 36*a* of the actuator 36 can be set to a possibly smallest value, contributing the reduction of the size, weight and cost of the actuator 36.

Further, in the shown embodiment, the actuator 36 is positioned below the optical axis Ax and has the output shaft 36*a* that extends substantially parallel to the optical axis Ax. As a result, the actuator 36 can be installed with ease, which also helps promote the size reduction of the lamp unit 20.

Further, in the shown embodiment, the link member 34 is comprised of the L-shaped portions 34A formed by the vertical parts 34A1, which extend substantially vertically downward from the connection point of the link member 34 and the moveable shade 32 (when viewed from the side of the lamp), and the horizontal part 34A2, which extend substantially rearward horizontally from the lower ends of the vertical parts 34A1 (when viewed from the side of the lamp). As a result, the lamp has the advantages as described below.

More specifically, in the shown embodiment, the drive of the actuator 36 is achieved by the linear reciprocating movement of the output shaft 36*a*, and this linear reciprocating movement is transmitted by the link member 34 to the moveable shade 32, so that the moveable shade 32 is rotated.

In this linkage, though the distance between the ends of the link member 34 would change slightly, since the link member 34 takes the structure that the L-shaped portions 34A are formed by the vertical parts 34A1 and the horizontal parts 34A2, the link member 34 can easily absorb any changes in the distance between the ends of the link member 34 by bending deformation of the L-shaped portions 34A. Further, as a result of this configuration, there is no need to provide a slide joint or the like at the portion connecting the link member 34 and the movable shade 32. Accordingly, the lamp unit 20 has a structure.

Furthermore, in the shown embodiment, the link member 34 is formed by the pair of L-shaped portions 34A, which are disposed on the left and right sides of the optical axis Ax, and the connecting portion 34B, which connects the L-shaped portions 34A at the rear ends of the horizontal parts 34A2 of the L-shaped portions 34A. Accordingly, the driving force of the actuator 36 can be reliably transmitted to the moveable shade 32, and, in addition, the L-shaped portion 34A can stably bend and deform without any problem.

In addition, since the link member 34 is formed by a wire spring, the L-shaped portions 34A easily bend and deform.

In the embodiment described above, the protrusions 34C of the link member 34 are rotatably connected to the moveable shade 32, and the connecting portion 34B of the link member 34 is rotatably connected to the output shaft 36*a* of the actuator 36. However, the connecting portion 34B and the output shaft 36*a* of the actuator 36 can be connected so as not to be rotated.

Further, as described above, in the shown embodiment, the center of gravity G of the moveable shade 32 is positioned 0.13 mm above and 0.1 mm in front of the rotational axis line Ax2. However, as long as the center of gravity G is positioned within the imaginary cylindrical region of a 1 mm radius about the rotational axis line Ax2, substantially the same operational effects as those of the above-described embodiment can be obtained.

Moreover, in the embodiment described above, the light source bulb 22 is inserted and fixed from the right side of the reflector 24. However, the light source bulb 22 can be inserted and fixed from the left side or from the rear side of the reflector 24 on the optical axis Ax.

The invention claimed is:

1. A vehicular headlamp comprising:

a projection lens provided on an optical axis of the vehicular lamp, the optical axis extending in a longitudinal direction of a vehicle;

a light source provided on a rear side of a rear focal point of the projection lens;

a reflector provided so as to reflect light from the light source forward and toward the optical axis;

a moveable shade provided so as to shield a part of the reflected light from the reflector, and an actuator that moves the moveable shade between a light shielding position at which an upper end edge of the moveable shade is positioned in the vicinity of the optical axis, and a light transmitting position at which the upper end edge of the moveable shade is positioned away from the optical axis; wherein the moveable shade is connected to the actuator via a link member and is rotatable about a rotational axis line that is in a direction of width of a vehicle, the upper end edge of the moveable shade is curved outwardly so that the curved upper edge is positioned substantially along a rear focal plane of the projection lens when the moveable shade is in the light shielding position, a center of gravity of the moveable shade is positioned in the vicinity of the rotational axis line, a distance from the rotational axis line to a connection point of the moveable shade and the link member is set to be smaller than a distance from the rotational axis line to the upper end edge of the moveable shade, said actuator is provided below the optical axis and has an output shaft that is substantially parallel to the optical axis, said link member is comprised of an L-shaped portion having a vertical part extending substantially vertically downward from the connection point of the moveable shade and the link member when viewed from a side of the lamp, and a horizontal part extending substantially horizontally from the lower end of the vertical part when viewed from the side of the lamp, and said link member comprises a pair of the L-shaped portions positioned on left and right sides of the optical axis and a connecting portion connecting tip ends of the horizontal parts of the L-shaped portions.

2. The vehicular headlamp according to claim 1, wherein said link member is a wire spring.

* * * * *